US006585263B1

(12) United States Patent
Bredenberg et al.

(10) Patent No.: US 6,585,263 B1
(45) Date of Patent: Jul. 1, 2003

(54) DECELERATION DRUM ASSEMBLY CONTAINING AIR GUIDES

(75) Inventors: Paul Emmett Bredenberg, Portsmouth, NH (US); Rich Daniel Curley, Dover, NH (US); John Lee Ketchum, Old Orcard Beach, ME (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/495,967

(22) Filed: Feb. 2, 2000

(51) Int. Cl.[7] ..... B65H 5/02

(52) U.S. Cl. ..... 271/276; 271/275; 271/277; 271/69; 271/306; 271/176; 271/182; 271/314; 271/82; 198/644; 406/52; 406/87

(58) Field of Search ..... 271/275, 276, 271/277, 69, 306, 314, 82, 182, 176; 198/644

(56) References Cited

U.S. PATENT DOCUMENTS

| | | | | | |
|---|---|---|---|---|---|
| 4,099,463 | A | * | 7/1978 | Zimmermann et al. | 101/230 |
| 5,141,221 | A | * | 8/1992 | Mack et al. | 271/270 |
| 5,288,067 | A | * | 2/1994 | Stock | 271/276 |
| 5,323,703 | A | * | 6/1994 | Blaser | 101/247 |
| 5,411,251 | A | * | 5/1995 | Schmid et al. | 271/195 |
| 5,419,256 | A | * | 5/1995 | Pollich | 101/485 |
| 5,452,886 | A | | 9/1995 | Cote et al. | |
| 5,497,987 | A | * | 3/1996 | Henn et al. | 271/204 |
| 5,546,858 | A | * | 8/1996 | Stephan | 101/142 |
| 5,738,760 | A | * | 4/1998 | Svanqvist et al. | 162/193 |
| 5,797,327 | A | * | 8/1998 | Gieser et al. | 101/483 |
| 5,807,227 | A | * | 9/1998 | Field | 493/424 |
| 5,816,155 | A | | 10/1998 | Stephan | |
| 5,927,203 | A | * | 7/1999 | Gieser et al. | 101/419 |
| 5,941,520 | A | * | 8/1999 | Stephan et al. | 271/195 |
| 5,988,633 | A | * | 11/1999 | Henn et al. | 271/204 |
| 6,027,112 | A | * | 2/2000 | Guenther et al. | 271/194 |
| 6,039,316 | A | * | 3/2000 | Jackson et al. | 250/559.27 |
| 6,056,323 | A | * | 5/2000 | McDonald | 283/61 |
| 6,116,593 | A | * | 9/2000 | Cote et al. | 271/211 |
| 6,131,784 | A | * | 10/2000 | Helgesson et al. | 226/91 |
| 6,135,026 | A | * | 10/2000 | Kalbantner et al. | 101/232 |
| 6,138,565 | A | * | 10/2000 | Koch et al. | 101/420 |
| 6,170,819 | B1 | * | 1/2001 | Crosby et al. | 271/196 |

FOREIGN PATENT DOCUMENTS

| | | | | |
|---|---|---|---|---|
| DE | 19819388 A1 | * | 1/1999 | G05B/13/02 |
| EP | 0842885 A2 | * | 5/1998 | B65H/29/68 |

* cited by examiner

*Primary Examiner*—Donald P. Walsh
*Assistant Examiner*—Jeffrey A. Shapiro
(74) *Attorney, Agent, or Firm*—Laurence A. Greenberg; Werner H. Stemer; Ralph E. Locher

(57) ABSTRACT

A deceleration drum assembly has a deceleration drum with at least one gripper for gripping and transporting signatures. A guide surface assembly is provided which produces a fluid flow for transporting the signature in a contactless manner above the guide surface assembly.

14 Claims, 5 Drawing Sheets

DECELERATION DRUM ASSEMBLY CONTAINING AIR GUIDES

BACKGROUND OF THE INVENTION

1. Field of the Invention

The invention relates, generally, to folders, and more specifically, to a folder having a deceleration drum with air guides.

2. Description of the Related Art

It is known in the art to provide a deceleration drum in a folding machine for slowing down signatures transported in the folding machine. Such a device is known from U.S. Pat. No. 5,452,886 to Cote et al.. Cote et al. teach a deceleration drum that is provided with a plurality of rotary grippers that positively grip signatures exiting a tape conveyor system and traveling at a high velocity and decelerates the signatures through a smooth velocity profile. In the deceleration process, the speed of the individual grippers can be controlled so as to overlap adjacent signatures for forming a shingled pile of signatures. The rotary grippers grip a leading edge of the signatures while the trailing edge is initially controlled by the tape conveyor system and later dragged alone a guide plate or a guide belt until delivered in a shingled form to an exit conveying system. Unfortunately, the trailing edges of the signatures that are dragged along the static plate or belt are apt to being marked, damaged and/or smudged.

U.S. Pat. No. 5,816,155 to Stephan teaches a printing press having printing units formed of an impression cylinder, a rubber blanket cylinder and a plate cylinder. Between the printing units a transfer drum is disposed for transferring signatures from one printing unit to the other printing unit. A guide surface member is provided around the transfer drum for assisting in transporting the signatures around the transfer drum in a contactless manner. The use of guide surface members for transporting signatures in a contactless manner is known in the art of transfer drums within the printing press but is not believed to known to be used in further processing machines (i.e. folders) disposed downstream of the printing presses. For instance, the use of guide surface members for transporting signatures is not believed to be known to be used in conjunction with deceleration drums of a folder.

SUMMARY OF THE INVENTION

It is accordingly an object of the invention to provide a deceleration drum assembly containing air guides that overcomes the herein-mentioned disadvantages of the heretofore-known devices of this general type, in which signatures are transported in a contactless manner to avoid damaging the signature in its transport path around the deceleration drum.

With the foregoing and other objects in view there is provided, in accordance with the invention, a deceleration drum assembly, containing a deceleration drum having at least one gripper for gripping a signature; and a guide surface assembly providing a fluid flow for transporting the signature in a contactless manner above the guide surface assembly.

In accordance with an added feature of the invention, the guide surface assembly contains at least one guide surface member having a surface with a plurality of nozzles formed therein. Air supply chests and fans are provided disposed below the guide surface assembly for supplying air to the nozzles. In this manner, the fans in conjunction with the nozzles can supply both blast air and suction air for controlling and transporting the signature.

In accordance with an additional feature of the invention, the guide surface assembly is formed successively of an entry region, a guide zone region and an exit region. The nozzles in the entry region and the exit region supply both blast air and suction air. The blast air prevents the signature from contacting the guide surface member and the suction air allows frictional forces to build between the signature and the guide surface member for controlling the signature. In this manner, a precise control of the signature can occur while transporting the signature. In addition, the suction air mode allows one to control the placement of the signature should the deceleration drum assembly need to be temporarily shut down in which precise placement of the signature is desirable.

In accordance with another feature of the invention, at least some of the fans in the entry region and the exit region are reversible fans for supplying the blast air and the suction air to some of the nozzles. It is further advantages if the fans are adjustable speed fans for adjusting an air flow rate.

In accordance with a further added feature of the invention, the nozzles are slit nozzles. In addition it is preferred if some of the nozzles are oriented to provide an air flow that is perpendicular to a signature travel direction for tautening the signature. Furthermore, positioning the nozzles to provide an air flow that both tautens and assists in transporting the signature is desirable.

In accordance with a further additional feature of the invention, the nozzles are disposed on the guide surface member in an array having a distribution varying in density and a distribution density of the nozzles is greatest in a middle of a signature travel path and decreases toward an edge of the signature travel path.

In accordance with a concomitant feature of the invention, the guide surface member has at least one recess formed therein and including at least one sensor disposed in the at least one recess. The at least one sensor outputting sensor data determining at least one of a height of the signature above the guide surface assembly, an air pressure under the signature, and a position of the signature in regards to the guide surface member. A control unit is provided that is connected to the sensors and to the fans for controlling the fans in response to the sensor data. Finally, it is possible to have a plurality of sensors disposed on either the guide surface member or on the deceleration drum.

Other characteristic features of the invention are set forth in the appended claims.

Although the invention is illustrated and described herein as embodied in deceleration drum assembly containing air guides, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
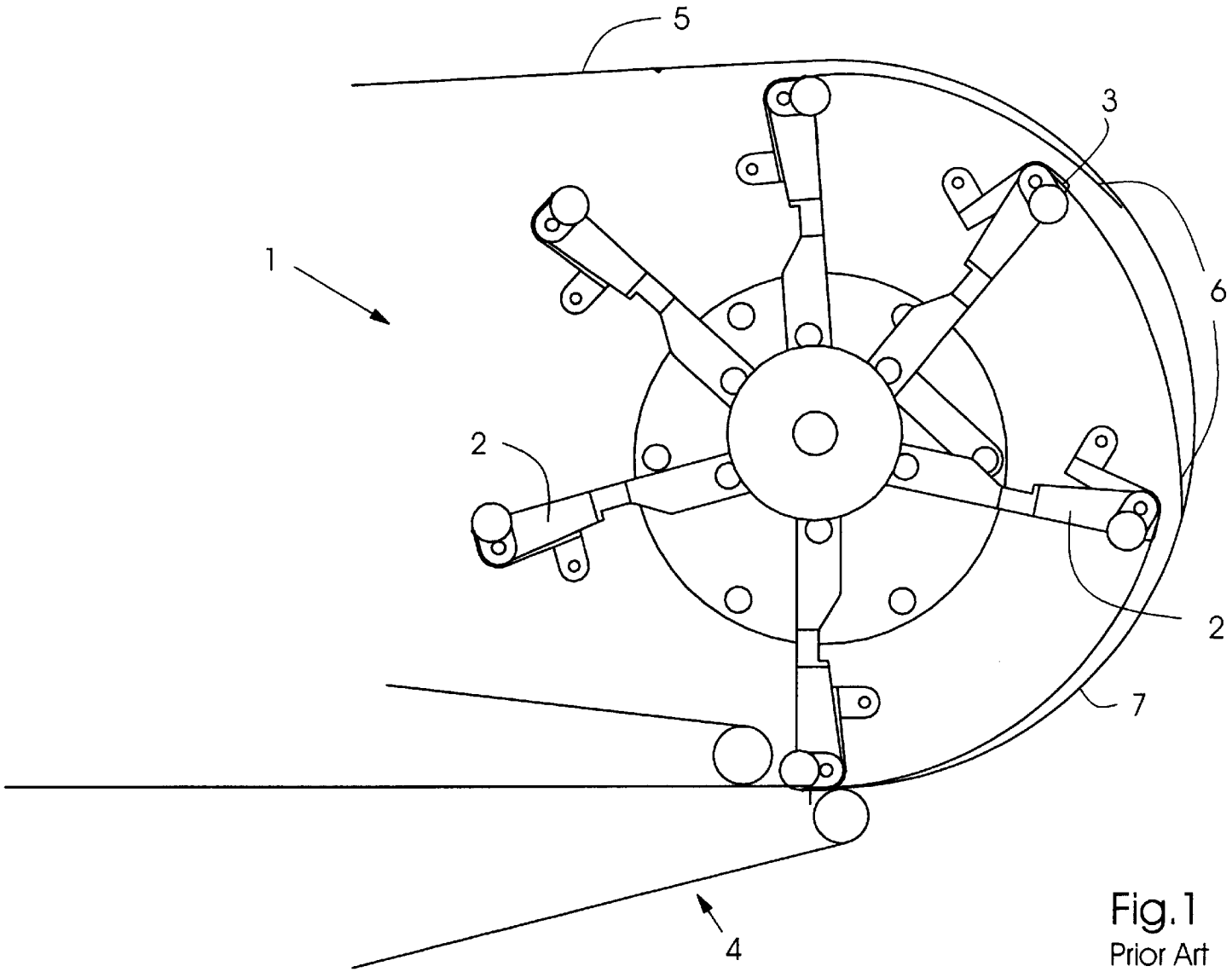
Fig. 1 Prior Art
FIG. 1 is a diagrammatic, side-elevational view of a prior art deceleration drum assembly.

In all the figures of the drawing, sub-features and integral parts that correspond to one another bear the same reference symbol in each case. Referring now to the figures of the drawings in detail and first, particularly, to FIG. 1 thereof, there is shown a prior art deceleration assembly of a printing press containing a deceleration drum 1. The deceleration drum 1 includes a plurality of grippers 2 for gripping a leading edge of a signature 3. The signatures 3 are released from a first transportation system 4, decelerated and optionally shingled by the deceleration drum 1, and released to a second transportation system 5.

A trailing edge 6 of the signature 3 is held against a signature guide 7. Centrifugal force is relied upon to keep the trailing edge 6 of the signature 3 against the guide 7 while the leading edge of a downstream signature 3 is lead past the trailing edge 6 of the upstream signature 3 for shingling the signatures 3. Unfortunately, the signature 3 being held by centrifugal forces is dragged along the signature guide 7 and is subjected to being damaged such as tearing, smudging, marking, folding, etc.

Figure 2:
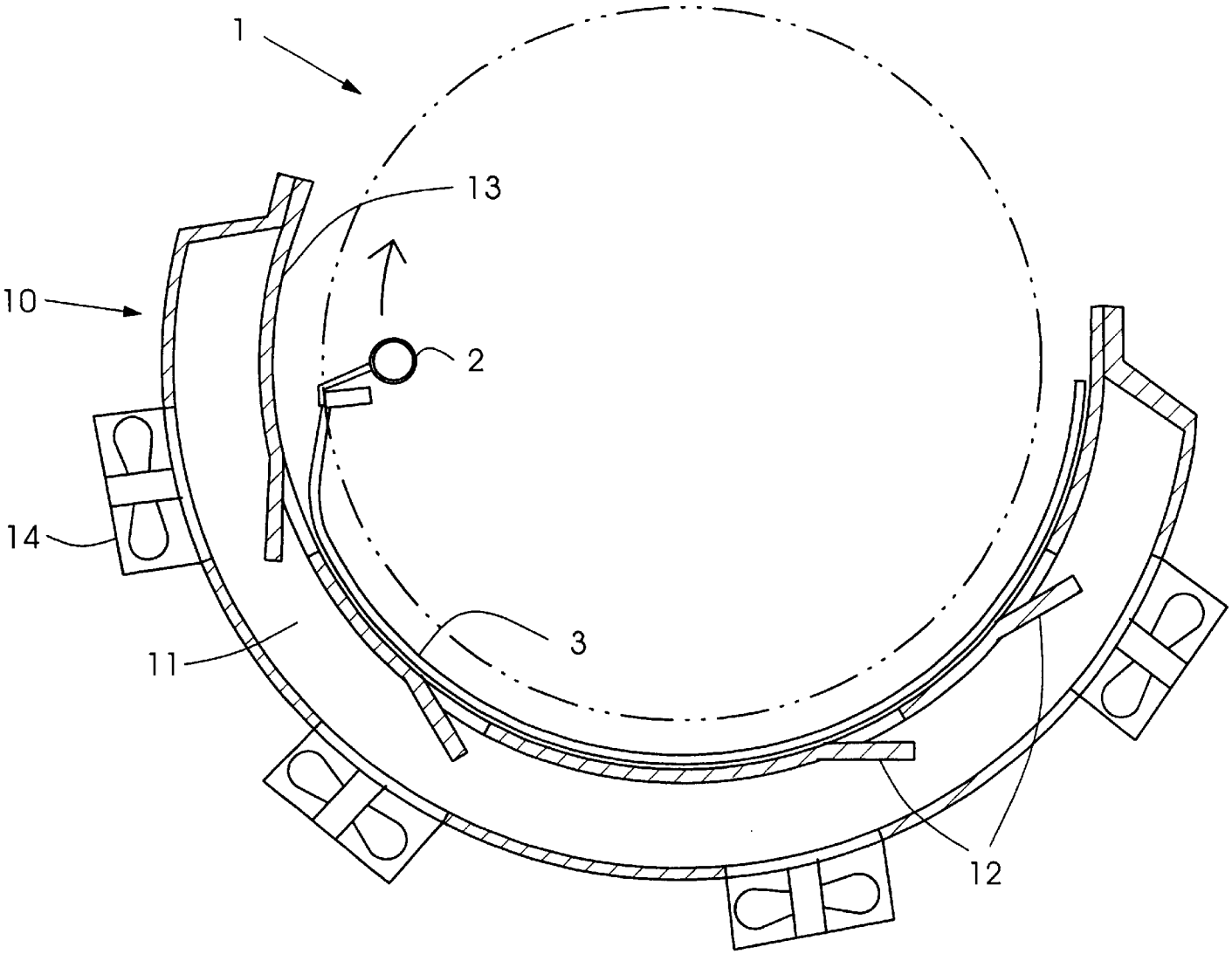
FIG. 2 is a sectional view of the deceleration drum assembly according to the invention.

FIG. 2 shows the deceleration drum assembly according to the invention in which the deceleration drum 1 is shown mainly in dashed lines so that comprehension of the invention is better understood. The signature 3, including the trailing edge 6, is suspended in a contactless manner between an air guide system 10 and the deceleration drum 1. The air guide system 10 is formed of one or more guide surface members or deflectors 11 having a number of nozzles 12 for conducting a flow medium such as air towards the signature 3. The nozzles 12 are constructed so that at least some of the air blasts substantially tangentially to a surface 13 of the guide surface members 11 in a region formed between the signature 3 and the guide surface member 11. The air flow and the surface 13 of the guide surface member 11 define an angle there-between which may, for example, be between 0.1° and 90°. The configuration of the nozzles 12 and a direction in which they blow are also preferably selected so that the air flows of adjacent nozzles groups are superimposed into a total flow having substantially parallel flow-lines.

Figure 3:
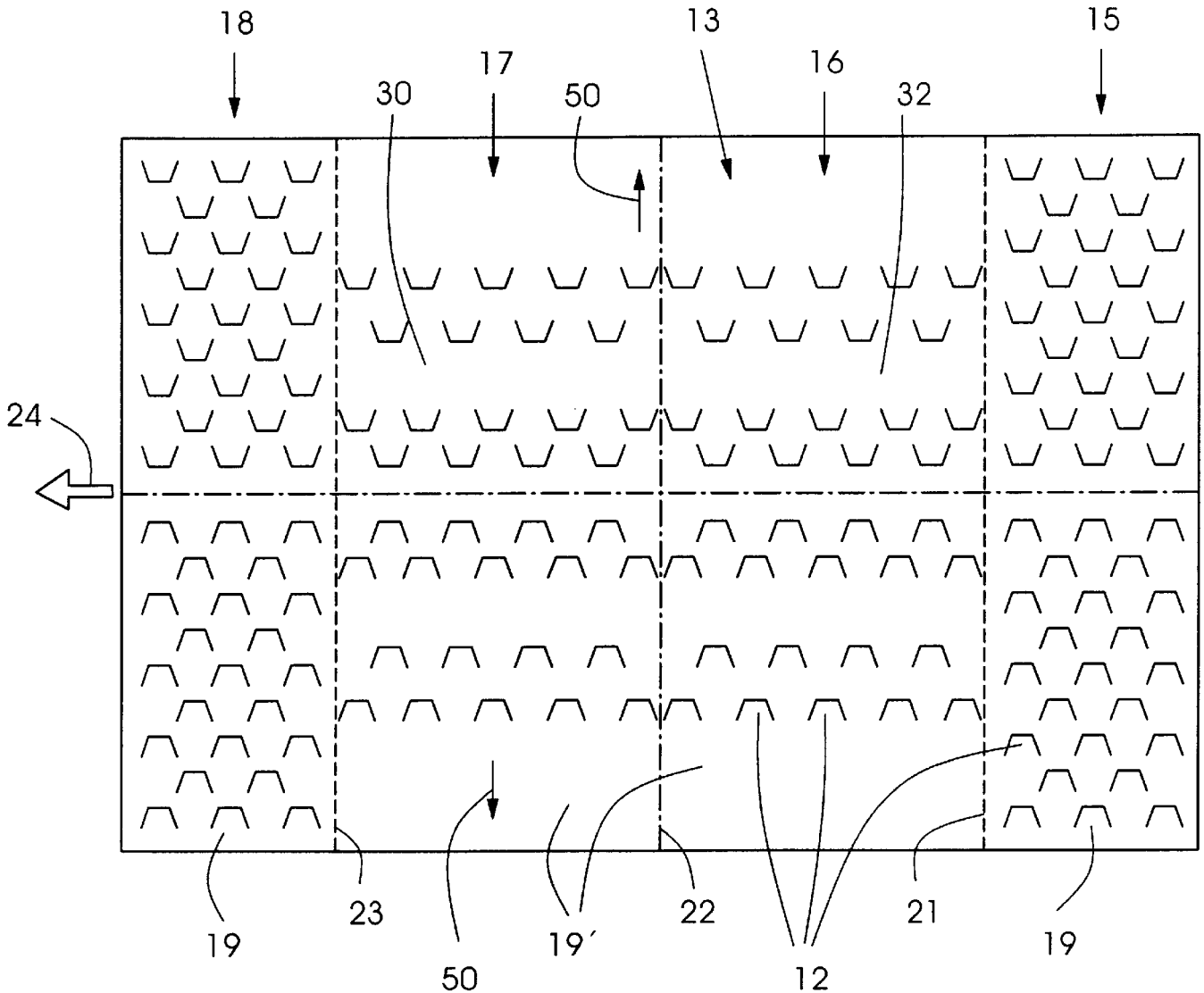
FIG. 3 is a top plan view of a guide surface member.

As is shown in FIG. 3, the guide surface member 11 for the deceleration drum 1 can have a total of four nozzle regions 15, 16, 17 and 18, divided by partitions 21, 22 and 23, and acted upon with air by a respective axial fan 14. The nozzle regions 15, 16, 17 and 18 are formed of a plurality of nozzles 12, which are disposed behind one another as seen in the viewing direction of FIG. 3.

When the sheet guiding system 10 is in a blowing or blast mode, the signature 3 experiences a floating or suspension guidance wherein it is guided between the deceleration drum 1 and the guide surface member 11 without contacting the surface 13 of the guide surface member 11. Such a floating guidance is necessary after perfecter printing, for example, because neither side of the signature 3 must be allowed to become smeared by the deceleration drum 1 or the guide surface member 11.

Figure 4:
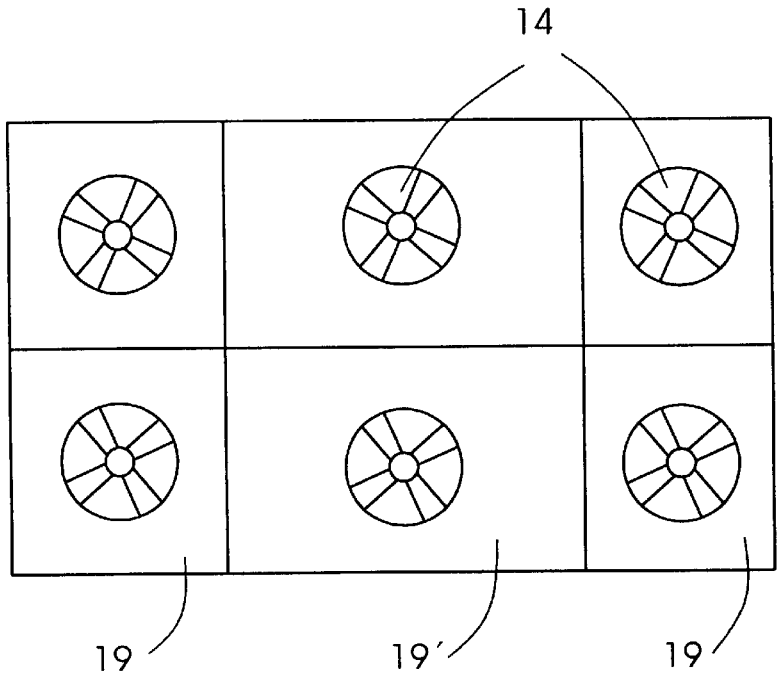
FIGS. 4–6 are plan views of fan configurations in the guide surface member.

FIGS. 3 and 4 show the guide surface member 11 having the nozzles 12 that are acted upon with air provided by air supply boxes or chests 19, 19'. The guide surface member 11 is shown in a plan view in FIGS. 3 and 4, with the partitions 21, 22 and 23 represented by broken lines or in phantom providing for a subdivision thereof into the various air supply boxes or chests 19, 19'. A density per unit of surface area of the nozzles 12 which are embodied as slit nozzles 12 is preferably varied. In an entry region 15, for example, two air supply boxes or chests 19 are provided, which have a relatively high density of nozzles 12 per unit of surface area. They are followed by guide zones 16, 17 having an areal density of nozzles 12 that is greater in a middle region thereof than at edges thereof. The guide zones 16 and 17 for example, correspond to the nozzle regions 30 and 32, wherein an application of blown or blast air is adequate for any operating mode of the printing press. The guide zone 17 is followed in a signature travel direction 24 by an exit region 18 which has a higher density of the nozzles 12 and wherein relatively strong holding or retention forces must act upon the signature 3 in a suction-air operating mode.

Figure 5:
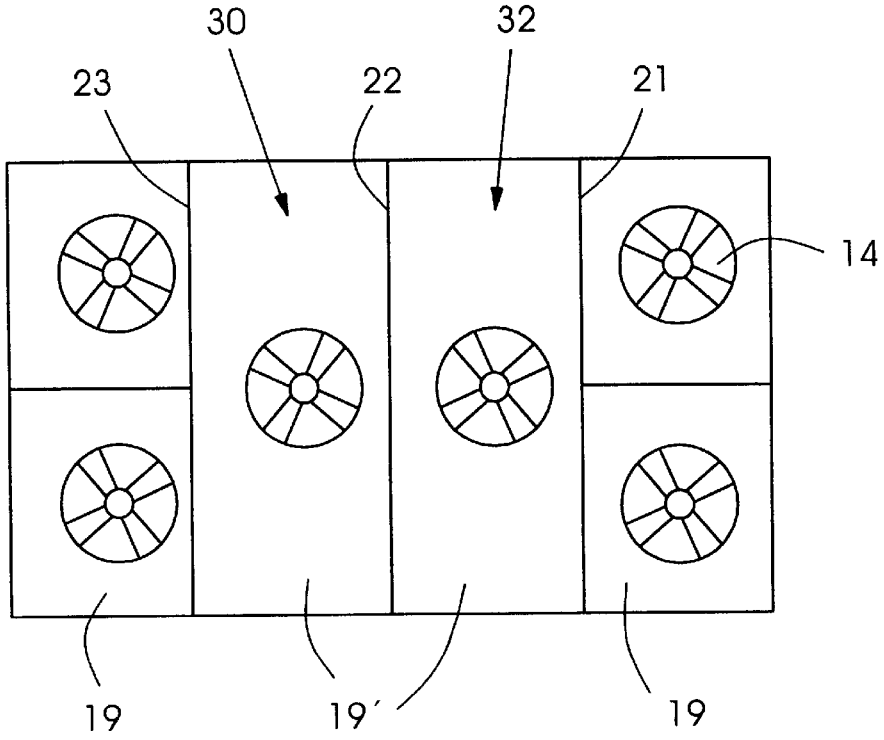

FIG. 4 shows how the axial fans 14 can be associated with the air supply chests 19, 19' shown in FIG. 3. It is also possible, however, to dispose the air supply chests 19 and 19' and the axial fans 14 in the manner shown in FIG. 5. This configuration is substantially equivalent to the configuration of air supply chests 19, 19' with the partitions 21, 22 and 23 shown in FIG. 3.

Figure 6:
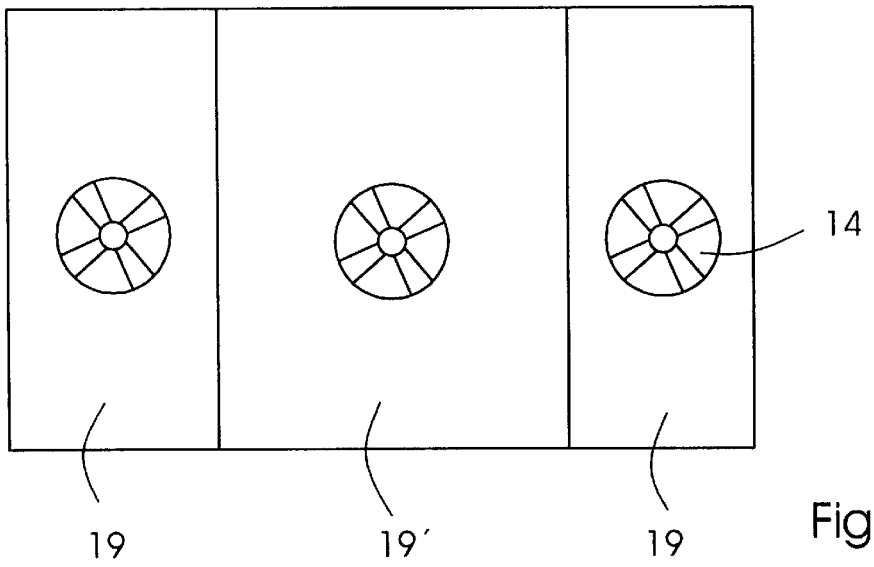

If a lesser amount of air is required, one of the subdivisions can be dispensed with, so that only one blower chest 19", respectively, is provided in the entry region 15 and in the exit region 18, and a large blower chest 19'" is provided in the guide zones 16 17, as shown in FIG. 6.

Figure 7:
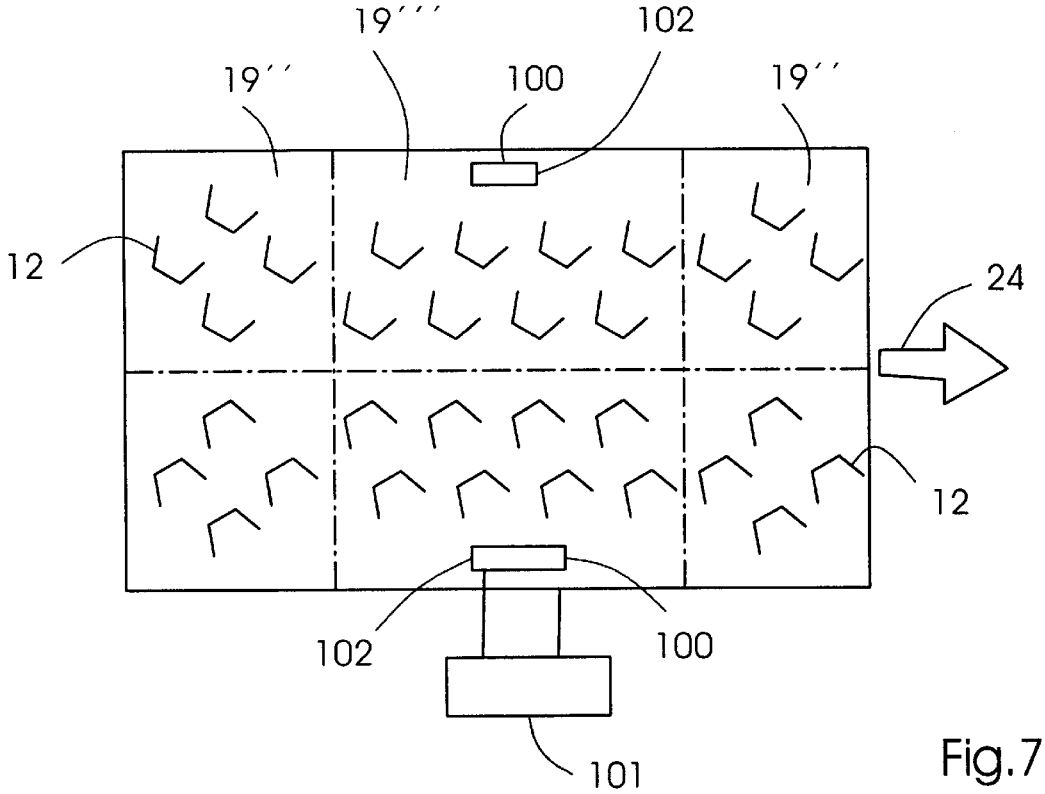
FIG. 7 is a plan view of an alternative nozzle configuration.

An alternative nozzle array is shown in FIG. 7 in which air is blown to assist in transporting the signature 3 in addition to tautening the signature 3. Of course, it is possible to use many other configurations of the nozzles 12 and FIG. 7 is used to illustrate this point. Sensors 100 are provided in recesses 102 formed in the surface 13 of the guide surface member 11. The sensors 100 are connected in turn to a control unit 101. The control unit 101 in turn is connected to the fans 14 and controls the functioning of the fans in response to sensor data. In this manner, a height of the signature 3 above the guide surface assembly 11, an air pressure provided under the signature 3, a position of the signature 3 in regard to the guide surface assembly 11, etc. be monitored and the fans 14 can be controlled in response to the data collected by the sensors 100. The sensors 100 are shown embedded in the guide surface member 11 but could also be position on the deceleration drum 1. Furthermore, additional sensors 100 can be provided at different positions on the guide surface member 11 and FIG. 7 shows only one of many possible combinations.

Figure 8:
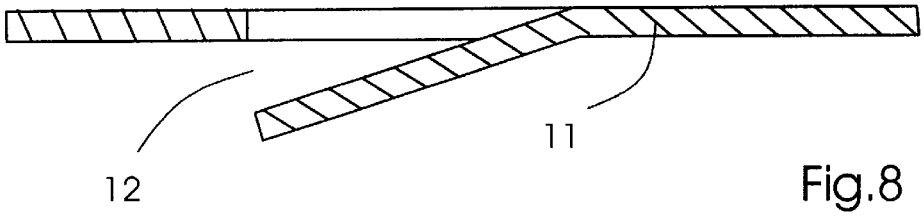
FIG. 8 is a sectional view of a nozzle.

FIG. 8 shows the preferred embodiment of the nozzles 12 that has already been indicated in FIGS. 2, 3 and 7. This involves slit nozzles 12, which can be stamped in a relatively simple manner into the sheet metal of the guide surface members 11. In the configuration shown in FIG. 3, the direction of blowing is directed outwardly as represented by arrows 50, which tautens the signature 3 transversely or crosswise to the travel direction thereof. To that end, it is necessary for two strong, outwardly directed air flows to be formed in the middle and move towards the side of the signature 3, those air flows, as they travel towards the outside, being maintainable by a lesser number of nozzles 12.

If first-form or recto printing mode of printing is preformed, however, an underside of the signature 3 is unprinted, and floating guidance is not absolutely necessary. In critical sections, guidance of the signatures 3 along the guide surface members 11 may be selected, so as to achieve better control over the signature 3. To that end, the axial fans 14 are reversible fans 14 and are switched to the suction mode in the entry region 15 and the exit region 18 of a respective corresponding guide surface member 11. The signature 3 can thereby slide along the guide surface members 11 in the regions 15 and 18, and friction forces can arise between the signatures 3 and the guide surface 13 of the guide surface members 11. The signature 3 is consequently held in the entry region 15 so that when the deceleration drum 1 is in a slow operating mode or is stopped, the signature 3 will not drop downwardly at the rear or trailing end thereof, so that the signature 3 does not become creased thereby. The suction mode in the exit region 18 also leads to a tautening or stretching of the signature 3, so that labile or soft papers, especially those with a low weight per unit of surface area, such as Bible paper, for example, can be surrendered, i.e., transferred, to the second transportation system 5 even at maximum speed without producing waviness or trapped air bubbles. In this way, even problematic papers can be printed with high quality and at maximum speed, while minimal machine reset times are maintained. Guidance of the signature 3 along the guide surfaces of the guide surface members 11 in the exit region 18 can also be helpful even with less problematic papers, for example, if the deceleration drum 1 is running correspondingly fast and, thereby, great centrifugal forces are exerted upon the signature 3 which can drive it outwardly and consequently cause a fluttering of the signature 3. In this case as well, the holding or retention forces generated by the previously described guidance in both the air blowing and the suction mode and exerted upon the signature 3 along the guide surfaces of the guide surface members 11 can serve to apply the signature 3 cleanly to the second transportation system 5.

The exemplary embodiments merely illustrate possibilities for constructing the sheet guiding assembly 10 of the invention. Other constructions with different nozzle arrays and, if necessary or desirable, other blowing or blast directions are also conceivable within the scope of the invention. Instead of the axial fans 14, a central air supply with blown or blast air and suction air or different types of fans may also be used.

We claim:

1. In combination with a folding machine of a web fed printing press, a deceleration drum assembly, comprising:

a deceleration drum disposed in the folding machine, said deceleration drum having a plurality of rotary grippers, said rotary grippers gripping, decelerating, and overlapping signatures;

a guide surface assembly containing at least one guide surface member;

said guide surface assembly providing a fluid flow for transporting the signature in a contactless manner above said guide surface assembly; and said guide surface member having at least one recess formed therein and including at least one sensor disposed in said at least one recess, said at least one sensor outputting sensor data determining at least one of a height of the signature above said guide surface member, an air pressure under the signature, and a position of the signature in regards to said guide surface member.

2. The deceleration drum assembly according to claim 1, wherein said guide surface assembly contains at least one guide surface member having a surface with a plurality of nozzles formed therein.

3. The deceleration drum assembly according to claim 2, including air supply chests and fans disposed in said air supply chests for supplying air to said guide surface assembly.

4. The deceleration drum assembly according to claim 3, wherein said fans can supply both blast air and suction air to said nozzles.

5. The deceleration drum assembly according to claim 3, wherein said guide surface assembly is formed successively of an entry region, a guide zone region and an exit region.

6. The deceleration drum assembly according to claim 5, wherein said nozzles in said entry region and said exit region supply both blast air and suction air, the blast air preventing the signature from contacting said guide surface member, and the suction air allowing frictional forces to build between the signature and said guide surface member for controlling the signature.

7. The deceleration drum assembly according to claim 6, wherein at least some of said fans in said entry region and said exit region are reversible fans for supplying the blast air and the suction air to some of said nozzles.

8. The deceleration drum assembly according to claim 1, wherein said nozzles are slit nozzles.

9. The deceleration drum assembly according to claim 2, wherein some of said nozzles are oriented to provide an air flow that is perpendicular to a signature travel direction for tautening the signature.

10. The deceleration drum assembly according to claim 2, wherein some of said nozzles are oriented to provide an air flow that both tautens and assists in transporting the signature.

11. The deceleration drum assembly according to claim 5, wherein said nozzles are disposed on said guide surface member in an array having a distribution varying in density and a distribution density of said nozzles is greatest in a middle of a signature travel path and decreases toward an edge of said signature travel path.

12. The deceleration drum assembly according to claim 3, wherein said fans are adjustable speed fans for adjusting an air flow rate.

13. The deceleration drum assembly according to claim 1, including a control unit connected to said sensors and to said fans for controlling said fans in response to said sensor data.

14. The deceleration drum assembly according to claim 13, wherein said at least one sensor is a plurality of sensors.

* * * * *